United States Patent [19]

Montanari

[11] 4,101,820

[45] Jul. 18, 1978

[54] FAIL-SAFE RESISTOR

[75] Inventor: Piero Montanari, Turin, Italy

[73] Assignee: WABCO Westinghouse, Turin, Italy

[21] Appl. No.: 792,639

[22] Filed: May 2, 1977

[30] Foreign Application Priority Data

May 6, 1976 [IT] Italy ..... 68105 A/76

[51] Int. Cl.[2] ..... H01C 7/12

[52] U.S. Cl. ..... 323/94 R; 338/325; 338/334; 337/297

[58] Field of Search ..... 337/124, 139, 140, 158, 337/159, 160, 296, 297; 338/215, 262, 273, 292, 293, 295, 308, 309, 314, 325, 334; 323/94 R

[56] References Cited

U.S. PATENT DOCUMENTS

| | | | |
|---|---|---|---|
| 3,887,893 | 6/1975 | Brandt et al. | 337/297 |
| 3,898,603 | 8/1975 | Cricchi et al. | 337/297 |
| 3,978,443 | 8/1976 | Dennis et al. | 338/309 |
| 4,031,497 | 6/1977 | Ozawa | 338/334 |

*Primary Examiner*—Gerald Goldberg

*Attorney, Agent, or Firm*—A. G. Williamson, Jr.; R. W. McIntire, Jr.

[57] ABSTRACT

Each pair of two pairs of terminals is connected by a conducting strip formed of a metallic material deposited on a fragile support block. The terminal connectors are shaped in an interwoven pattern, with an intervening space, such that the support block will not break along the space pattern. The connector strips are connected by a resistance material deposited along the space pattern and overlapping the adjoining strips. The four terminals are connected into a circuit arrangement so that the resistance material forms part of a vital resistor network which if interrupted causes that circuit arrangement to assume a safe condition. Any rupture of the resistance material and/or the support block due to thermal differences or mechanical force interrupts the continuity of one or both connector strips to create a safe failure condition.

12 Claims, 5 Drawing Figures

FAIL-SAFE RESISTOR

BACKGROUND OF THE INVENTION

My invention pertains to a fail-safe resistor. More particularly, the invention relates to a four terminal resistor for use in vital circuitry to assure a safe failure if the resistor opens.

In general, resistors are considered safe circuit elements since the usual failure is an open circuit fault which interrupts operation of the apparatus. However, in some electrical circuits using resistors, e.g., voltage divider networks, the breaking of a resistor, due to mechanical forces or chemical corrosion, may cause the output signal supplied to the next circuit element or a feedback signal to increase in value. This at least causes an incorrect operation of the circuit arrangement. More seriously, the fault may create an unsafe condition, particularly in railroad signaling or control apparatus. Thus a requirement exists that some arrangement be provided to cancel or inhibit an improper output. Special circuit connections are possible and have been used but only with extra circuit complications and additional cost.

Accordingly, an object of my invention is an improved, vital resistor which interrupts the circuit connections and assuredly cancels the output signal if the resistor breaks.

A further object of the invention is a four terminal resistor so constructed that any structural break will interrupt the continuity of the circuit arrangement in which used.

Another object of the invention is a fail-safe resistor formed by resistance material deposited between two terminal connector strips deposited on a fragile support block with terminals at each end of each strip, structured such that any breakage of the resistance material or the support block opens one or both connector strips to interrupt the circuit between input and output terminals.

Other objects, features, and advantages of the invention will become apparent from the following specification and claims when taken with the accompanying drawings.

SUMMARY OF THE INVENTION

In the construction of the basic form of the resistor of the invention, two pairs of terminals are provided. Each pair is connected by a conductor strip formed by a metallic coating deposited on a nonconducting support such as a rectangular ceramic block. Each strip extends lengthwise on the block in a pattern similar to a Greek square. The two patterns are interleaved but separated by a predetermined spacing. Over the center part of the block, exclusive of the four terminals, the two strips are connected by a layer of resistance material laid along the spacing pattern and overlapping the adjacent conductor strips. The resistance of the element thus lies between the two strips, or, from one pair of terminals to the other pair. The resulting resistance and terminal pattern is such that any break in the support block will assuredly break at least one conductor strip and thus interrupt the circuit paths between the terminal pairs and also the resistance path. The input circuit, which may include other circuit elements, is coupled across one terminal of each pair to include the resistance element in the circuit. The output signal is taken across the other terminal of each pair so that interruption of one or both connections between the terminal pairs disconnects the output.

BRIEF DESCRIPTION OF THE DRAWINGS

In describing specific embodiments of the invention, reference will be made to the accompanying drawings, in which.

In each of the drawing figures, similar references designate the same or similar parts of the apparatus.

DESCRIPTION OF THE ILLUSTRATED EMBODIMENT

Figure 1:
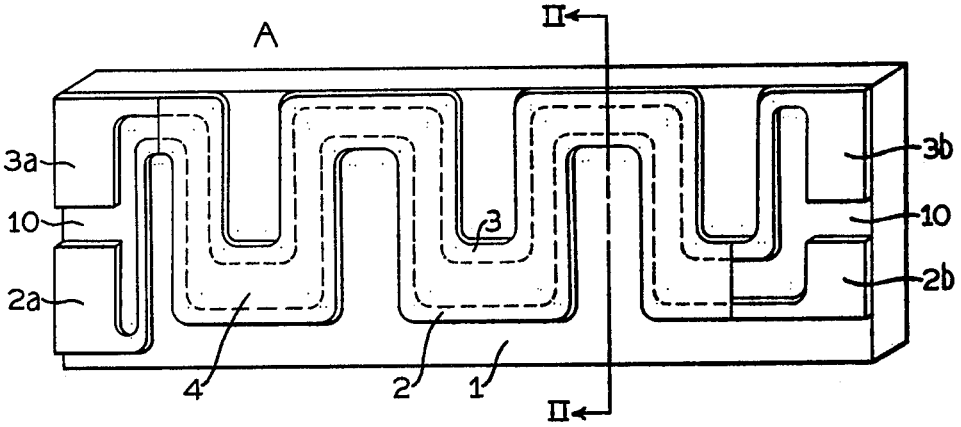
FIG. 1 is a perspective front view of a resistor constructed according to a first embodiment of the invention.

Referring to FIG. 1, the resistor A shown therein is constructed according to the thick-film, hybrid circuit technique. The reference 1 designates a support block, for the resistor, made of a fragile material such as ceramic. Deposited or mounted on block 1 are metallic strips 2 and 3, of conducting material, which terminate in terminals *2a, 2b,* and *3a, 3b,* respectively. In other words, resistor A has two pair of terminals *2a, 2b* and *3a, 3b,* one terminal of each pair being associated at each end of block 1, and each pair being joined by a connector strip of conducting material. Each connector strip is formed in a zigzag pattern, also called a Greek square pattern. The two patterns are interleaved, as shown, but the connectors are everywhere along their lengths separated by the space 10.

Figure 2:
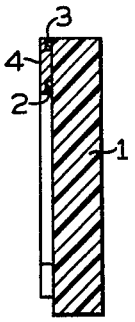
FIG. 2 is a cross section of the resistor along line II—II of FIG. 1.

The two connector strips are connected, however, by an overlaid plate 4, as shown in the cross-section of FIG. 2. Plate 4 is formed of a resistance material deposited on support block 1 in a pattern following space 10, but excluding the terminal area at each end of the block. As better illustrated in FIG. 2, plate 4 fills space 10 and overlaps the adjacent connectors 2 and 3. This results in a resistance circuit, i.e., a resistor, between strip 3 and strip 2. In other words, a circuit connected to terminals *3a* and *2a,* or *3b* and *2b,* includes resistor A having a resistance value provided by plate 4.

Because of the interleaved patterns of connectors 2 and 3, any break in the resistor element will cause one or both of these connectors to also break to interrupt the circuit connection between the corresponding terminals. It is also highly improbable that any break in block 1 will follow exactly the pattern of space 10 and leave the connector strips intact. The dimensions of support block 1 are selected, in accordance with the specific material of which made, so that it will break, as a result of the difference between coefficients of thermal expansion of block 1 and resistance material 4, in case the power applied to the resistor exceeds the rated value. This prevents the prolonged application of excessive power, such as to cause material 4 to volatilize, from producing an open circuit through the resistor while retaining circuit connections between each pair of terminals.

Figure 3:
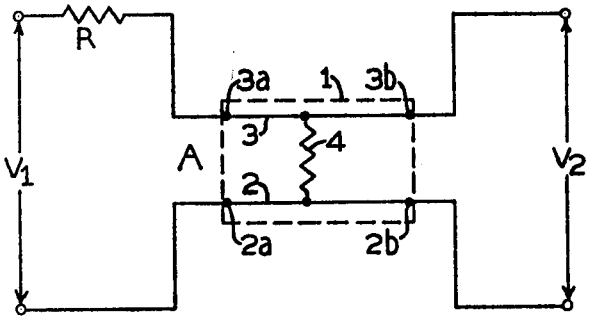
FIG. 3 is a circuit diagram showing the connection of the resistor of FIG. 1 into a specific circuit network.

In FIG. 3, resistor A of FIG. 1 is shown connected into a resistor voltage divider network, a typical use for such units. Support block 1 is shown in dashed outline with the mounted circuit elements indicated within, between the designated terminals of the resistor. The voltage divider network includes a conventional resistor R and resistance element 4 of the invention device. The input voltage $V_1$ is applied across resistors R and 4 in series, with terminals 3a and 2a in the circuit. The output voltage is connected across terminals 3b and 2b. It is apparent that, if resistance 4 is a conventional type and without special circuit precautions, an open circuit through resistance 4 will cause voltage $V_2$ to increase, a potentially dangerous condition. However, by using resistor A, any break in block 1 and/or damage to resistance 4 will also interrupt connector 2 or 3, possibly both, and disconnect the output terminals 3b, 2b from the divider network, thus reducing $V_2$ to zero. If an over-voltage occurs in source $V_1$, so that the voltage divider circuit carries too much current and resistance material 4 eventually vaporizes, i.e. volatilizes, the difference in thermal expansion between the material of block 1 and resistance 4 causes block 1 to break and interrupt connectors 2 and 3 to disconnect output $V_2$.

Figure 4:
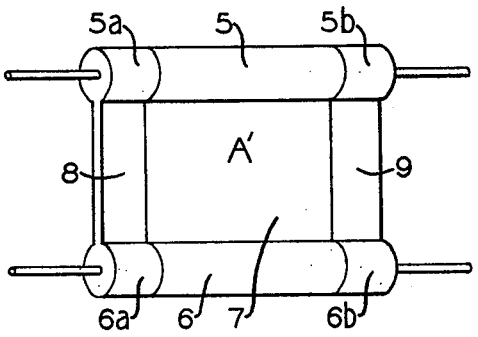
FIG. 4 is a perspective view of another form of resistor embodying the invention.

A modified form of resistor A is illustrated in FIG. 4. The references 5 and 6 each designate a resistor of the metallic-layer type, each having a metallized terminal at each end, i.e., terminals 5a, 5b and 6a, 6b, respectively. A support 7 made of fragile material holds resistors 5 and 6 positioned in a selected relationship. A metallic coating 8 deposited on support 7 connects terminals 5a and 6a while a similar conductor 9 connects terminals 5b and 6b. Support 7 is so designed and dimensioned that its mechanical resistance is less than that of either resistor 5 or 6. Thus any breakage of resistor 5 or 6 also causes support 7 to break in a manner that connectors 8 and 9 break and interrupt the continuity of the complete resistor network between terminals 5a, 6a and 5b, 6b.

Figure 5:
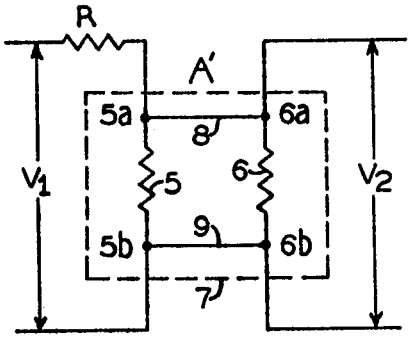
FIG. 5 is a circuit diagram illustrating the specific connections of the resistor of FIG. 4 into a circuit arrangement similar to that of FIG. 3.

This resistance network is shown in more detail in FIG. 5 in which the use of resistor A′ in a voltage divider network is illustrated. The input voltage $V_1$ is connected across resistors R and A′ in series, which circuit includes terminals 5a and 5b. The value of resistor A′ is determined by the parallel paths through individual resistors 5 and 6. The output voltage $V_2$ is then taken across this parallel network by connecting across terminals 6a and 6b. Any interruption of connectors 8 or 9 thus disconnects the output from the input.

The use of a resistor embodying the principles of this invention in vital resistance networks effectively assures, in an efficient and economical manner, that the breaking or burn up of the resistance element will not result in the occurrence of an unsafe condition in the circuit operation.

Although only two specific forms of resistors embodying the invention have been shown and described, it is to be understood that other changes and modifications within the scope of the appended claims may be made without departing from the spirit and scope of the invention.

Having thus described the invention, what I claim is:

1. A fail-safe, four terminal resistor device comprising,
(a) a support element of fragile, non-conducting material,
(b) two pairs of terminals mounted in spaced relationship on said support element,
(c) a separate connector strip of metallic material deposited on said support element for connecting each pair of terminals, and
(d) a resistance means coupled between said connector strips for providing a resistance circuit between said pairs of terminals,
(e) said resistance means so mounted on said support element that any damage to said resistance means interrupts the continuity of at least one connector strip.

2. A resistor device as defined in claim 1 in which,
(a) an input circuit is coupled across a first terminal of each pair of terminals, and
(b) an output circuit is connected across the other terminal of each pair, whereby any interruption of a connector strip disconnects the output circuit from said input.

3. A resistor device as defined in claim 1 in which,
(a) each connector strip is formed into a selected pattern, interleaved with the pattern of the other strip so that corresponding portions are substantially parallel but spaced apart on the surface of said support element,
(b) said resistance means is a plate of resistance material deposited on said support element along the space pattern between and overlapped onto said connector strips for completing the resistance circuit between the pairs of terminals, and
(c) the resulting overlay pattern of strips and resistance material is so formed that any breakage of said support element interrupts the continuity of at least one connector strip and said resistance plate.

4. A resistor device as defined in claim 3 in which,
(a) said support element is composed of a ceramic material having a predetermined coefficient of thermal expansion, and
(b) the resistance material has a coefficient of thermal expansion different than the coefficient of said support element, whereby said support element breaks to interrupt the continuity of at least one connector strip if damaging excess power is applied to said resistor device.

5. A resistor device as defined in claim 4, in which,
(a) said selected pattern of said connector strips is such that the intervening space has a Greek square pattern between the terminals at each end of the support element, and
(b) said resistance material is deposited in the same pattern as said intervening space to assure that any breakage of said support element will interrupt the continuity of at least one connector strip.

6. A resistor device as defined in claim 5 in which,
(a) an input circuit is coupled across a first terminal of each pair of terminals, and
(b) an output circuit is connected across the other terminal of each pair, whereby any interruption of a connector strip disconnects the output circuit from said input.

7. A resistor device as defined in claim 1 in which,
(a) said resistor means comprises a pair of metallic-layer resistors having a terminal at each end,
(b) said support element and deposited metallic connector strips are structured for holding and connecting said pair of resistors in parallel, with each strip connecting said resistor terminals at the corresponding ends of said resistors, and
(c) the mechanical resistance of said support element is substantially less than that of said resistors for assuring that breakage of a resistor causes said support element to also break and interrupt the continuity of at least one connector strip.

8. A vital resistor device comprising, (a) a support block of non-conducting fragile material, (b) a pair of metallic, conducting strips mounted on said support in spaced but substantially parallel relationship, each strip having a terminal at each end positioned adjacent to the associated terminal of the other strip, and (c) a resistance element having a predetermined resistance coupled for completing a circuit between said pair of conductor strips in a manner that damage to any part of said support block or said resistance element results in the interruption of circuit continuity through at least one of said conductor strips.

9. A resistor device as defined in claim 8 in which, (a) each conductor strip is formed into a preselected pattern, with the pattern of one strip interleaved into the pattern of the other strip to maintain the substantially parallel alignment along each portion of said strips, and (b) said resistance element is formed to follow the pattern of the space between a selected portion of said conductor strips exclusive of said terminals and to overlay each adjacent strip to complete the resistance circuit.

10. A resistor device as defined in claim 9 in which, (a) each conductor strip is a metallic coating deposited on said support block in said preselected pattern, and (b) said resistance element is deposited along the space pattern between said parallel conductor strips and of a width to overlap only the adjacent strips.

11. A resistor device as defined in claim 10 in which, said support block is of a material of selected thermal coefficient of expansion sufficiently different from the thermal coefficient of expansion of said resistance material to cause said support block to break when the power applied to the resistor exceeds its rated value for an extended period of time, such as to result in an open circuit through said resistance element.

12. A fail-safe voltage divider network for supplying an output voltage which is a selected portion of an input voltage, comprising in combination, (a) a first resistor having a preselected value, (b) a second resistor comprising, (1) a support element of fragile non-conducting material, (2) two pair of terminals separately mounted on said support with one terminal and the other terminal of each pairs in associated relationships, each pair connected by a metallic strip deposited on said support element and whose continuity is interrupted by any breakage of said support element, (3) resistance material coupled to form a resistor circuit of preselected value between the two metallic connector strips, (c) said first resistor and said resistance material of said second resistor connected in a series circuit, including the one associated terminal of each pair of terminals of said second resistor, in which the preselected value of said resistance element represents a portion of the total series resistance equivalent to the desired portion of output voltage, (d) an input voltage source connected to said series circuit, and (e) an output voltage circuit connected across the other associated terminals of each pair of terminals for supplying the selected portion of output voltage only when the support element and the resistance element are unbroken.

* * * * *